US006031344A

United States Patent [19]

Foo et al.

[11] Patent Number: 6,031,344

[45] Date of Patent: Feb. 29, 2000

[54] METHOD FOR DRIVING A FIELD EMISSION DISPLAY INCLUDING FEEDBACK CONTROL

[75] Inventors: Ken K. Foo; Kim Hasler, both of Chandler, Ariz.

[73] Assignee: Motorola, Inc., Schaumburg, Ill.

[21] Appl. No.: 09/046,749

[22] Filed: Mar. 24, 1998

[51] Int. Cl.[7] ..... H05B 37/02

[52] U.S. Cl. ..... 315/307; 315/307; 315/169.1; 315/291

[58] Field of Search ..... 315/169, 169.1, 315/169.2, 169.3, 169.4, 224, 168, 167, 107; 445/24; 345/60, 67

[56] References Cited

U.S. PATENT DOCUMENTS 4,090,106 5/1978 Okumura et al. ..... 315/107
5,477,110 12/1995 Smith et al. ..... 315/169.3
5,581,159 12/1996 Lee et al. ..... 315/167
5,656,892 8/1997 Zimlich et al. ..... 315/169.3
5,700,175 12/1997 Wang et al. ..... 445/24

*Primary Examiner*—Don Wong
*Assistant Examiner*—Tuyet Vo
*Attorney, Agent, or Firm*—Kate Tobin; Jasper Dockrey; Kevin D. Willis

[57] ABSTRACT

A method for driving a field emission display (100) includes the steps of applying a drive signal (146) to an emission electrode (113) and manipulating the drive signal (146) using a feedback controller to control an electrode voltage signal (158) at the emission electrode (113). A field emission display (100) includes a field emission display device (110), a feedback controller (123), and a current source (120). The current source (120) is connected to an input (144) of the field emission display device (110). An output (131) of the feedback controller (123) is connected to an input (127) of the current source (120), and the input (144) of the field emission display device (110) is connected to the input (129) of the feedback controller (123).

9 Claims, 2 Drawing Sheets

200

200

METHOD FOR DRIVING A FIELD EMISSION DISPLAY INCLUDING FEEDBACK CONTROL

FIELD OF THE INVENTION

The present invention pertains to the area of field emission devices and, more particularly, to methods for driving field emission displays.

BACKGROUND OF THE INVENTION

It is known in the art to drive a field emission display (FED) using a voltage source, which is connected to each conductive column. To control the current at the electron emitting elements, a ballast layer is provided between the electron emitting elements and the conductive columns. However, including a ballast layer results in additional process steps in the fabrication of the FED. The ballast layer also may not solve the problem of poor emission characteristics at low voltages. The emission characteristics at low voltages are adversely affected by the capacitance of the device.

Prior art methods of driving a FED also include using analog-to-digital converters and pulse width modulation circuitry. These circuits add to driver complexity and power requirements.

Accordingly, there exists a need for an improved method for driving a field emission display and an improved field emission display, which overcome at least these shortcomings.

Figure 1:
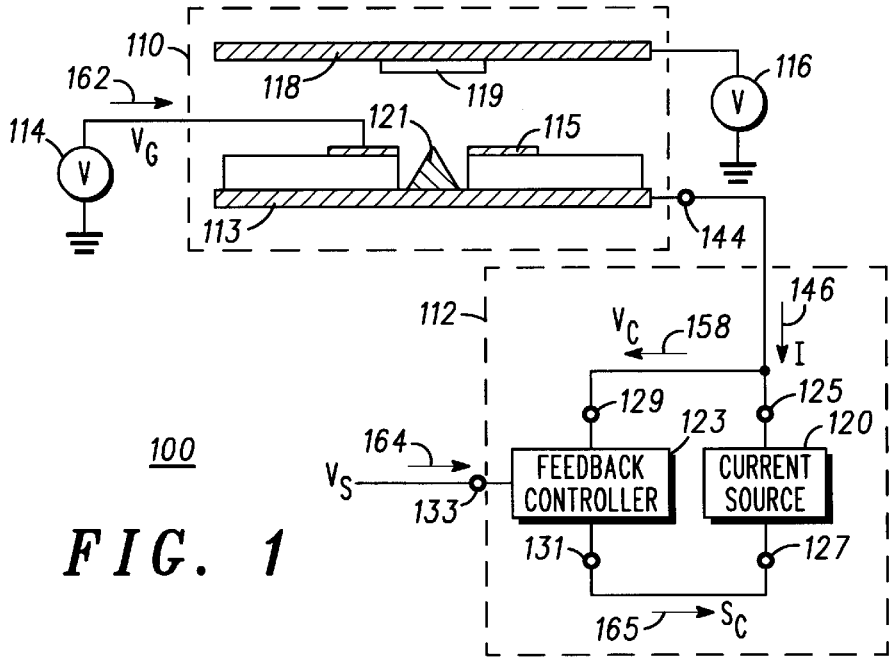
FIG. 1 is a schematic representation of a FED in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a method for driving a FED and a FED, which has a conductive column and a current source. An output of the current source is connected to the conductive column. The FED of the invention further includes a feedback controller, which has an input connected to the conductive column and an output connected to the current source.

In accordance with the method of the invention, the feedback controller controls an electrode voltage signal at the conductive column by manipulating a drive current signal generated by the current source. The method of the invention provides improved control of the electron emission over that of the prior art.

The method of the invention further obviates the need for a ballast layer between the electron emitting elements and the conductive columns. The omission of a ballast layer reduces costs of materials and fabrication of the device. The method of the invention further increases tolerance for imperfections in the device, which improves product yield over that of the prior art. For example, the method of the invention provides an electron emission response that is generally independent of the presence of pixel defects and current leaks.

The method of the invention also obviates the need for circuitry for implementing analog-to-digital signal conversion and for pulse-width modulation. This improvement favorably reduces the power requirements of the device and simplifies the circuitry of the FED driver.

Referring now to FIG. 1, there is depicted a schematic representation of a FED 100 in accordance with a preferred embodiment of the invention. FED 100 includes a FED device 110 and a FED driver 112. FED device 110 includes an anode 118, which is made from a conductive, transparent material, such as indium tin oxide. A phosphor 119 is disposed on anode 118. Phosphor 119 is made from a cathodoluminescent material. A voltage source 116 is connected to anode 118.

Opposing anode 118 is a conductive column 113, which is made from a convenient conductive material. Conductive column 113 is a cathode with respect to anode 118. An electron emitter 121 is connected to conductive column 113 and is made from an electron-emissive material, such as molybdenum. A conductive row 115 circumscribes electron emitter 121 and is made from a convenient conductive material. A voltage source 114 is connected to conductive row 115.

In the preferred embodiment of FIG. 1, FED driver 112 is connected to an input 144 of conductive column 113. However, a FED driver in accordance with the invention is not limited to connection to conductive columns, such as illustrated in FIG. 1. A FED driver in accordance with the invention can be connected to any of various emission electrodes for causing electron emission according to a video data signal. For example, the FED driver can be connected to conductive rows 115.

In the preferred embodiment of FIG. 1, FED driver 112 includes a current source 120 and a feedback controller 123. An output 125 of current source 120 is connected to input 144 of conductive column 113. An input 127 of current source 120 is connected to an output 131 of feedback controller 123. Feedback controller 123 further includes a first input 129, which is connected to input 144 of conductive column 113, and a second input 133, to which is applied a voltage set point signal during the operation of FED 100.

Methods for fabricating FED device 110 are known to one skilled in the art. The geometry and materials of a FED device embodying the invention are not limited to those shown in the figures. For example, the shape of the electron emitters is not limited to the conical shape shown in the figures and can include, for example, an emissive film.

The operation of FED 100 includes the step of applying an electrode voltage signal, $V_C$, 158 to conductive column 113 using FED driver 112. The operation of FED 100 further includes the step of applying a gate voltage signal, $V_G$, 162 to conductive row 115 using voltage source 114. The values for $V_C$ and $V_G$ are selected to control electron emission from electron emitter 121.

Typically, conductive row 115 overlies more than one conductive column, only one of which is shown in FIG. 1. The voltage applied to each conductive column can be independently controlled. The independent control is achieved by connecting a column driver to each of the conductive columns.

Gate voltage signal 162 is applied for a length of time typically referred to as the "line time". During the line time, an electrode voltage signal is applied to each of the conductive columns according to data encoded in a video data signal (not shown). The video data signal is an analog voltage signal encoding the voltage to be applied at each selectively addressable conductive column. The encoded voltage corresponding to a particular conductive column provides a voltage set point signal, $V_S$, 164 for the feedback controller connected to the corresponding conductive column. Voltage set point signal 164 is applied to second input 133 of feedback controller 123 and defines the set point value for the control of electrode voltage signal 158.

A method for driving a FED in accordance with the invention includes the step of applying a drive signal to an emission electrode. In the embodiment of FIG. 1, this step includes the step of applying a drive current signal 146 to input 144 of conductive column 113. Drive current signal 146 is generated by current source 120.

A method for driving a FED in accordance with the invention further includes the step of manipulating the drive signal with the feedback controller to control an electrode voltage signal at the emission electrode. In the embodiment of FIG. 1, this step includes the step of manipulating drive current signal 146 with feedback controller 123 to control electrode voltage signal 158 at conductive column 113.

In accordance with the preferred embodiment of the invention, the step of manipulating the drive signal includes the step of comparing voltage set point signal 164 with electrode voltage signal 158 to provide a comparison signal (not shown).

A controller output signal, $S_C$, 165 is responsive to the comparison signal. If the magnitude of electrode voltage signal 158 is less than the value encoded by voltage set point signal 164, the comparison signal causes feedback controller to generate controller output signal 165 to activate current source 120. Controller output signal 165 is applied to current source 120 and causes current source 120 to generate drive current signal 146 for correcting electrode voltage signal 158. In the preferred embodiment, drive current signal 146 is a constant electrical current for increasing the magnitude of electrode voltage signal 158.

When the magnitude of electrode voltage signal 158 equals the value encoded by voltage set point signal 164, the comparison signal causes feedback controller 123 to generate controller output signal 165 to deactivate current source 120. In the preferred embodiment, this step includes terminating the constant electrical current from current source 120 and providing no current or reduced current.

The method for driving a field emission display in accordance with the invention further includes the step of manipulating the drive signal to control the electrode voltage signal during the line time. In the embodiment of FIG. 1, this step includes manipulating drive current signal 146 to cause the magnitude of electrode voltage signal 158 to change in the direction of the magnitude encoded by voltage set point signal 164 throughout the line time.

Further in the operation of FED 100, a potential is applied to anode 118 using voltage source 116. The potential is selected to attract electrons emitted from electron emitters 121 toward phosphors 119. Phosphor 119 is caused to emit light upon bombardment by the emitted electrons.

Figure 2:
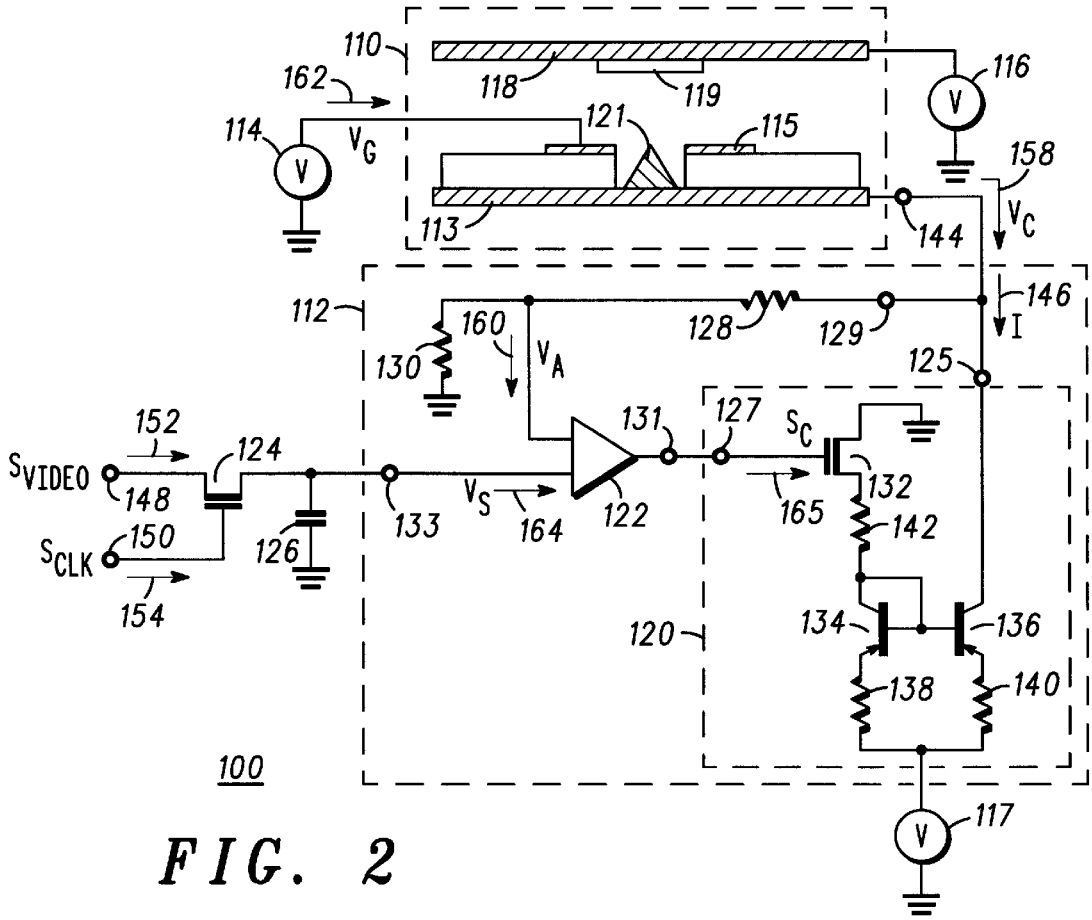
FIG. 2 is a schematic representation of a FED including circuitry for a FED driver in accordance with the preferred embodiment of the invention.

Referring now to FIG. 2, there is depicted a schematic representation of FED 100 including circuitry for FED driver 112 in accordance with the preferred embodiment of the invention. In the embodiment of FIG. 2, FED driver 112 includes current source 120, which has a current mirror configuration.

As illustrated in FIG. 2, FED driver 112 includes a first resistor 128, a second resistor 130, and a comparator 122, all of which constitute feedback controller 123. First resistor 128 reduces the magnitude of electrode voltage signal 158 to provide an adjusted voltage signal, $V_A$, 160, which is useful for comparison purposes within comparator 122.

In the embodiment of FIG. 2, current source 120 includes a switching transistor 132, a pair of PNP transistors 134, 136, a third resistor 138, a fourth resistor 140, and a fifth resistor 142, which are connected in the manner shown in FIG. 2. In the operation of the embodiment of FIG. 2, voltage set point signal 164 is applied to comparator 122. Controller output signal 165 is generated by comparator 122 and applied to the gate of switching transistor 132. A voltage source 117 is connected to current source 120 to supply the necessary power for activating and deactivating current source 120.

Further illustrated in FIG. 2 are a switching transistor 124 and a capacitor 126, which are connected to comparator 122. A video data signal, $S_{VIDEO}$, 152 is provided by external circuitry (not shown) and applied to a first input 148 of FED 100. A clock signal, $S_{CLK}$, 154 is applied to a second input 150 of FED 100.

Clock signal 154 causes switching transistor 124 to sample video data signal 152 at the portion of video data signal 152 that corresponds to electron emitter 121. Capacitor 126 is used for storing the sampled data.

Figure 3:
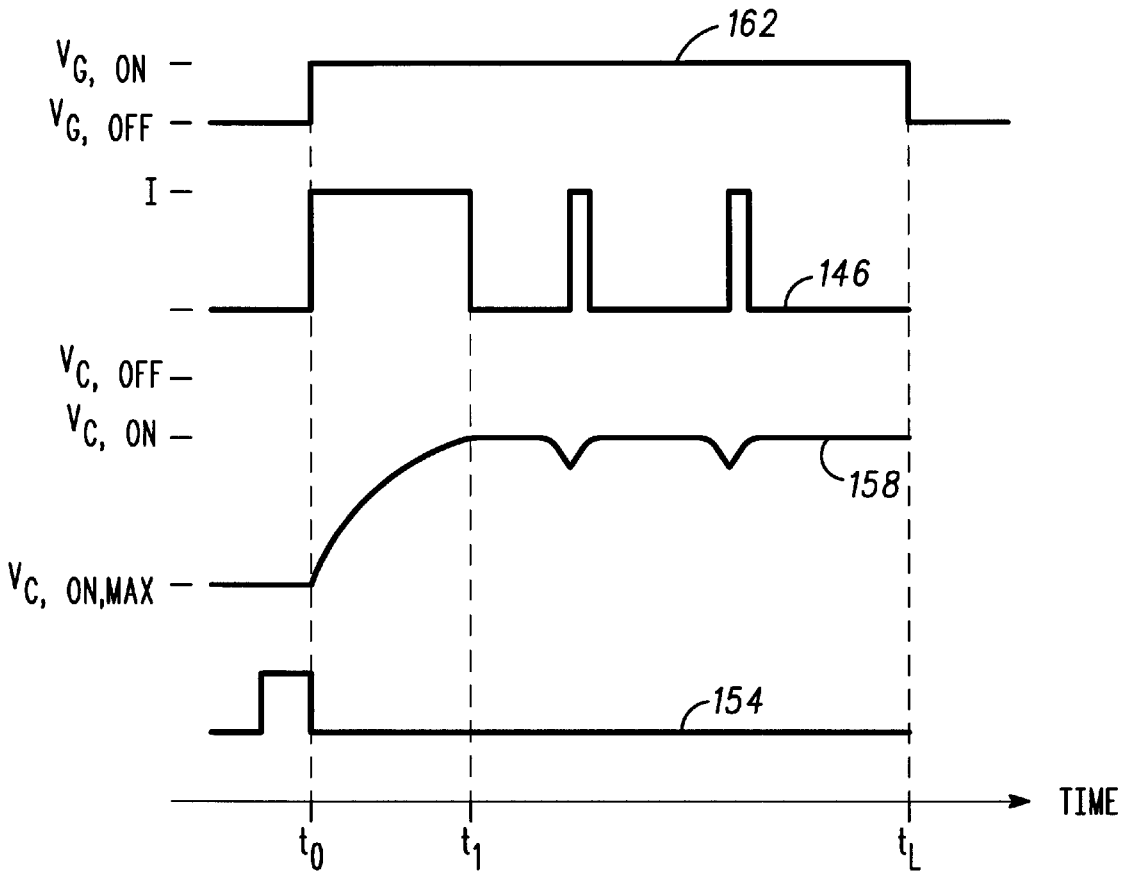
FIG. 3 is a timing diagram illustrating operating signals of a FED in accordance with the preferred embodiment of the invention.

Referring now to FIG. 3, there is depicted a timing diagram 200 illustrating operating signals of FED 100 in accordance with the preferred embodiment of the invention. Timing diagram 200 illustrates an example of the control provided by FED driver 112. In the operation of FED 100 (FIG. 2), prior to $t_0$, gate voltage signal 162 has a value, $V_{G,OFF}$, which is selected to prevent electron emission at electron emitter 121. Also prior to $t_0$, the value, $V_{C,ON,MAX}$, of electrode voltage signal 158 is selected to prevent electron emission at electron emitter 121. Prior to $t_0$, clock signal 154 applies a pulse to switching transistor 124 to cause sampling of video data signal 152.

At $t_0$ gate voltage signal 162 is changed to a value, $V_{G,ON}$, which is selected to allow electron emission at electron emitter 121. The value of $V_{G,ON}$ is applied for a duration equal to $t_L-t_0$, the line time.

During the line time, if the value of electrode voltage signal 158 is equal to $V_{C,OFF}$, electron emission does not occur; if the value of electrode voltage signal 158 is equal to $V_{C,ON,MAX}$, a maximum electron emission current is emitted from electron emitter 121. The electron emission current decreases as the value, $V_{C,ON}$, of electrode voltage signal 158 is increased from $V_{C,ON,MAX}$.

In the example of FIG. 3, it is desired to provide a value of electrode voltage signal 158 that is equal to $V_{C,ON}$. At $t_0$, a comparison between adjusted voltage signal 160 and voltage set point signal 164 causes comparator 122 to generate controller output signal 165 to activate current source 120. When activated, current source 120 generates drive current signal 146 having a current value, I, which is selected to increase the value of electrode voltage signal 158.

The value of I is further selected to cause the magnitude of $t_1-t_0$, the charge up time, to be much less than the magnitude of $t_L-t_0$, the line time, over the entire range of values for voltage set point signal 164. This eliminates the need to correct the drive signal for variation in the charge up time. In this manner, the method of the invention simplifies control of the electron emission current. The magnitude of $t_1$ relative to $t_L$ as depicted in FIG. 3 is exaggerated to facilitate understanding. Preferably, the charge up time is less than one tenth of the line time.

As further illustrated in FIG. 3, drive current signal 146 has the value I for a time equal to $t_1-t_0$. During this time, electrode voltage signal 158 increases until it attains the value $V_{C,ON}$, which is determined by voltage set point signal 164. When electrode voltage signal 158 reaches a value equal to $V_{C,ON}$, comparator 122 generates controller output signal 165 for deactivating current source 120 and causing drive current signal 146 to be reduced to, for example, zero current.

As further illustrated in FIG. 3 and in accordance with the invention, current source 120 can be repeatedly activated during the line time. At times after $t_1$ and during the line time, current source 120 is activated when the difference between adjusted voltage signal 160 and voltage set point signal 164 exceeds a predetermined value. Two such manipulations are illustrated in FIG. 3.

In summary, the invention is for a method for driving a FED and a FED. A feedback controller of the FED controls an electrode voltage signal at an emission electrode by manipulating a drive current signal. The method and FED of the invention provide improved control of electron emission and further provide simplified drive circuitry over that of the prior art.

We claim:

1. A method for driving a field emission display having an emission electrode, the method comprising the steps of:

applying a gate voltage signal, wherein the gate voltage signal is applied for a line time;

providing a video data signal, wherein the video data signal comprises an electrode voltage signal;

applying a drive signal to the emission electrode, wherein the drive signal is selected to provide a charge up time for the electrode voltage signal, and wherein the charge up time is less than one tenth of the line time;

providing a feedback controller; and manipulating the drive signal with the feedback controller to control the electrode voltage signal at the emission electrode.

2. The method for driving the field emission display as claimed in claim 1, wherein the step of applying the drive signal comprises the step of applying a drive current signal to the emission electrode.

3. The method for driving the field emission display as claimed in claim 1, further comprising the steps of providing a voltage set point signal and comparing the voltage set point signal with the electrode voltage signal to provide a controller output signal.

4. The method for driving the field emission display as claimed in claim 3, wherein the step of applying the drive signal comprises the step of applying a drive current signal to the emission electrode, further comprising the step of providing a current source for generating the drive current signal, and wherein the step of manipulating the drive signal with the feedback controller comprises the step of applying the controller output signal to the current source.

5. A method for driving a field emission display having an emission electrode, the method comprising the steps of:

providing a video data signal, wherein the video data signal comprises an electrode voltage signal;

applying the electrode voltage signal to the emission electrode;

providing a voltage set point signal;

comparing the electrode voltage signal of the emission electrode with the voltage set point signal to provide a comparison signal;

manipulating a drive signal in response to the comparison signal; and applying a gate voltage signal, wherein the gate voltage signal is applied for a line time; and applying a drive signal to the emission electrode, wherein the drive signal is selected to provide a charge up time for the electrode voltage signal, and wherein the charge up time is less than one tenth of the line time.

6. A method for driving a field emission display having an emission electrode, the method comprising the steps of:

applying a gate voltage signal, wherein the gate voltage signal is applied for a line time;

applying an electrode voltage signal to the emission electrode, wherein the electrode voltage signal has a magnitude and a charge up time, and wherein the charge up time is less than one tenth of the line time;

providing a voltage set point signal having a magnitude;

manipulating a drive signal to cause the magnitude of the electrode voltage signal to change in the direction of the magnitude of the voltage set point signal; and applying the drive signal to the emission electrode.

7. A method for driving a field emission display having a conductive row and a conductive column, the method comprising the steps of:

applying a gate voltage signal to the conductive row during a line time;

applying a drive signal to the conductive column, wherein the drive signal is selected to provide a charge up time, and wherein the charge up time is less than one tenth of the line time; and manipulating the drive signal to control an electrode voltage signal of the conductive column during the line time.

8. The method for driving the field emission display as claimed in claim 7, wherein the step of applying the drive signal to the conductive column comprises the step of applying a drive current signal to the conductive column.

9. A field emission display comprising:

an anode;

a phosphor disposed on the anode;

a cathode;

an electron emitter connected to the cathode, wherein the phosphor is disposed to receive electrons emitted by the electron emitter;

a drive current signal source connected to the cathode for applying a drive current signal to the cathode; and a feedback controller having an input connected to the cathode and an output connected to the drive current signal source, whereby the feedback controller manipulates the drive current signal source in response to an electrode voltage signal from the cathode;

applying a gate voltage signal, wherein the gate voltage signal is applied for a line time; and applying a drive signal to the emission electrode, wherein the drive signal is selected to provide a charge up time for the electrode voltage signal, and wherein the charge up time is less than one tenth of the line time.

* * * * *